US005678522A

United States Patent [19]

Han

[11] Patent Number: 5,678,522

[45] Date of Patent: Oct. 21, 1997

[54] FREE PISTON INTERNAL COMBUSTION ENGINE

[76] Inventor: William Han, 9, Alley 1, Lane 8, Hong-Tao St., Hsi-Chih Town, Taipei Hsien, Taiwan

[21] Appl. No.: 679,226

[22] Filed: Jul. 12, 1996

[51] Int. Cl.[6] ..... F02B 71/00

[52] U.S. Cl. ..... 123/465 C

[58] Field of Search ..... 123/46 SC, 46 E, 123/46 R

[56] References Cited

U.S. PATENT DOCUMENTS

| | | | |
|---|---|---|---|
| 3,673,999 | 7/1972 | Lacy et al. | 123/46 R |
| 3,766,399 | 10/1973 | Demetrescu | 123/46 E |
| 3,769,950 | 11/1973 | Braun | 123/46 SC |
| 4,154,200 | 5/1979 | Jarret et al. | 123/46 E |
| 4,491,095 | 1/1985 | Coad | 123/46 R |
| 4,876,991 | 10/1989 | Galitello, Jr. | 123/46 E |
| 5,002,020 | 3/1991 | Kos | 123/46 E |

*Primary Examiner*—David A. Okonsky
*Attorney, Agent, or Firm*—Alfred Lei

[57] ABSTRACT

A free piston internal combustion engine characterized in that the free piston is held by a magnet, fuel and compressed air are injected directly into the combustion chamber to start the engine. A spring is utilized to retract the piston at the beginning of each operating cycle. The movement of the piston and the output power of the hydraulic system are controlled by a computer.

5 Claims, 2 Drawing Sheets

FREE PISTON INTERNAL COMBUSTION ENGINE

BACKGROUND OF THE INVENTION

1. Field of the Invention

This invention is related to an improved free piston internal combustion engine and in particular to one which has a better thermal efficiency than the conventional internal combustion engine.

2. Description of the Prior Art

A variety of free piston engines were suggested in last decades on account of many generally recognized merits. Against the conventional engine, they are of low inertia, low friction, low pollution and low cost. The low-friction characteristic may become the important factor to build a ceramic engine. But, on the other hand, some problems happens simultaneously and those problems directly influence the usability of the free piston engine. As concerns the development from double acting to single acting, the stroke distance is more unstable. Free piston is pushed forward by expansion gas and pulled back by a spring and so the free piston internal combustion engine will not have fixed dead centers which happen in the conventional engine. Therefore, precise control on igniting timing, fuel injection, output power and velocity of pistion are needed. The high speed calculation of the microprocessor could promote the operation. Starting often makes the designer confused too.

Therefore, it is an object of the present invention to provide an improved free piston internal combustion engine which adopts fuel-air direct injection and a magnet to resolve this problem.

SUMMARY OF THE INVENTION

This invention relates to an improved free piston internal combustion engine.

It is the primary object of the present invention to provide a free piston internal combustion engine which has a better thermal efficiency than the conventional internal combustion engine.

It is another object of the present invention to proivde a free piston internal combustion engine which is of low pollution.

It is still another object of the present invention to provide a free piston internal combustion engine which can start or stop immediately as required.

It is still another object of the present invention to provide a free piston internal combustion engine which adopts direct fuel injection so that only a few fuel will escape from the exhaust port thereby causing a low fuel consumption.

It is still another object of the present invention to provide a free piston internal combustion engine which can promote a smooth and continuous movement by adjusting the output power.

It is a further object of the present invention to provide a free piston internal combustion engine which utilizes a microprocessor to offer precise and multi-function control.

DETAILED DESCRIPTION OF THE PREFERRED EMBODIMENT

Figure 1:
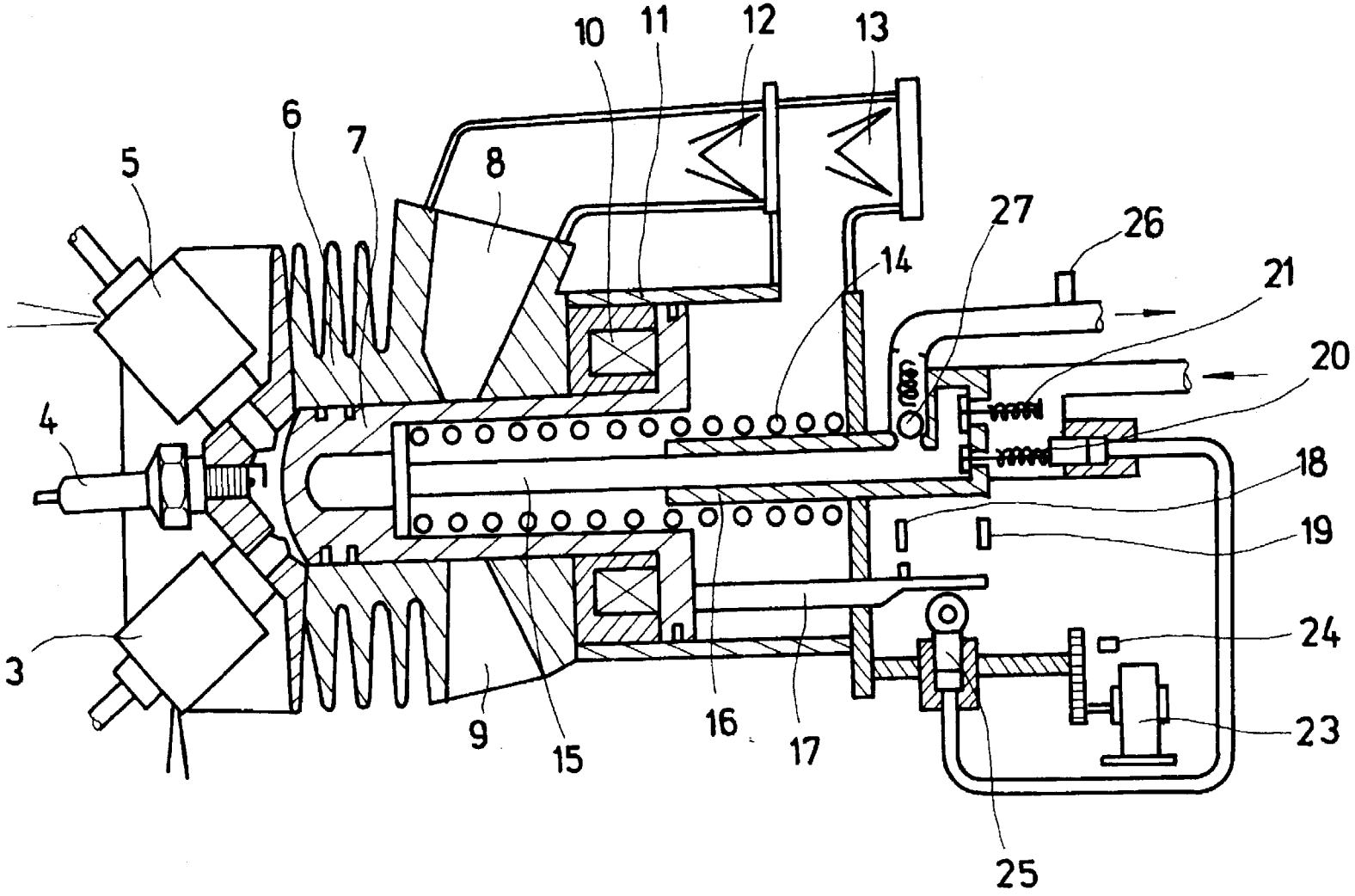
FIG. 1 is a sectional view of a free piston internal combustion engine according to the present invention.

With reference to the drawings and in particular to FIG. 1 thereof, the free piston internal combustion engine according to the present invention mainly comprises a cylinder assembly, a piston assembly 7, a hydraulic cylinder assembly and an electric control unit.

The cylinder assembly includes a power cylinder 6, an electromagnet 10 (or permanent magnet), and a scavenging cylinder 11. There is a cylinder head at the left end of the power cylinder 6. The cylinder head is provided with a fuel injector 3, a compressed air injector 5, and a spark plug 4. The fuel injector 3 and the spark plug 4 are for normal operating and starting cycles, while the compressed air injector 5 for starting only. The electromagnet 10 (or permanent magnet) is for starting. The right end of the power cyclinder 6 is formed with an intake port 8 and an exhaust port 9. As the piston is moved to the right, the scavenging cylinder 11 will supply fresh air through an exhaust valve 12 to the intake port 8. When the piston is moved to the left, air will be sucked through the intake valve 13 into the cylinder.

The piston assembly 7 is provided with sealing means at both ends. The rear end of the piston which is made of iron can contact tightly with the electromagnet 10 to form a closed magnetic circuit. The magnetic circuit is designed so that its attraction can hold the piston 7 in a fixed position. A hydraulic plunger 15 is arranged within the piston. A main spring 14 is fitted over the hydraulic plunger 15 and urges the piston assembly 7 against the left end of the cylinder. The main spring 14 saves energy in the power stroke and urges the piston assembly 7 to move leftward in the compression stroke. The right end of the piston is provided with a push rod 17 which extends out of the scavenging cylinder 11. The push rod 17 has a shoulder portion so that when the push rod 17 is moved to the right, the shoulder portion will press a follower 25 to go downwardly thereby pressing fluid to open a pressure relief valve 20. Meanwhile, the push rod 17 can interrupt the ignition sensor 18 and the fuel sensor 19 in sequence.

The hydraulic cylinder assembly is connected with the cylinder assembly and piston assembly 7 and includes the plunger 15, the housing and the cylinder head 16. On the cylinder head 6 are mounted an inlet valve 21, an outlet valve 27 and a pressure relief valve 20. The plunger 15 is used for squeezing and transferring fluid out of the cylinder to take off the power.

Figure 2:
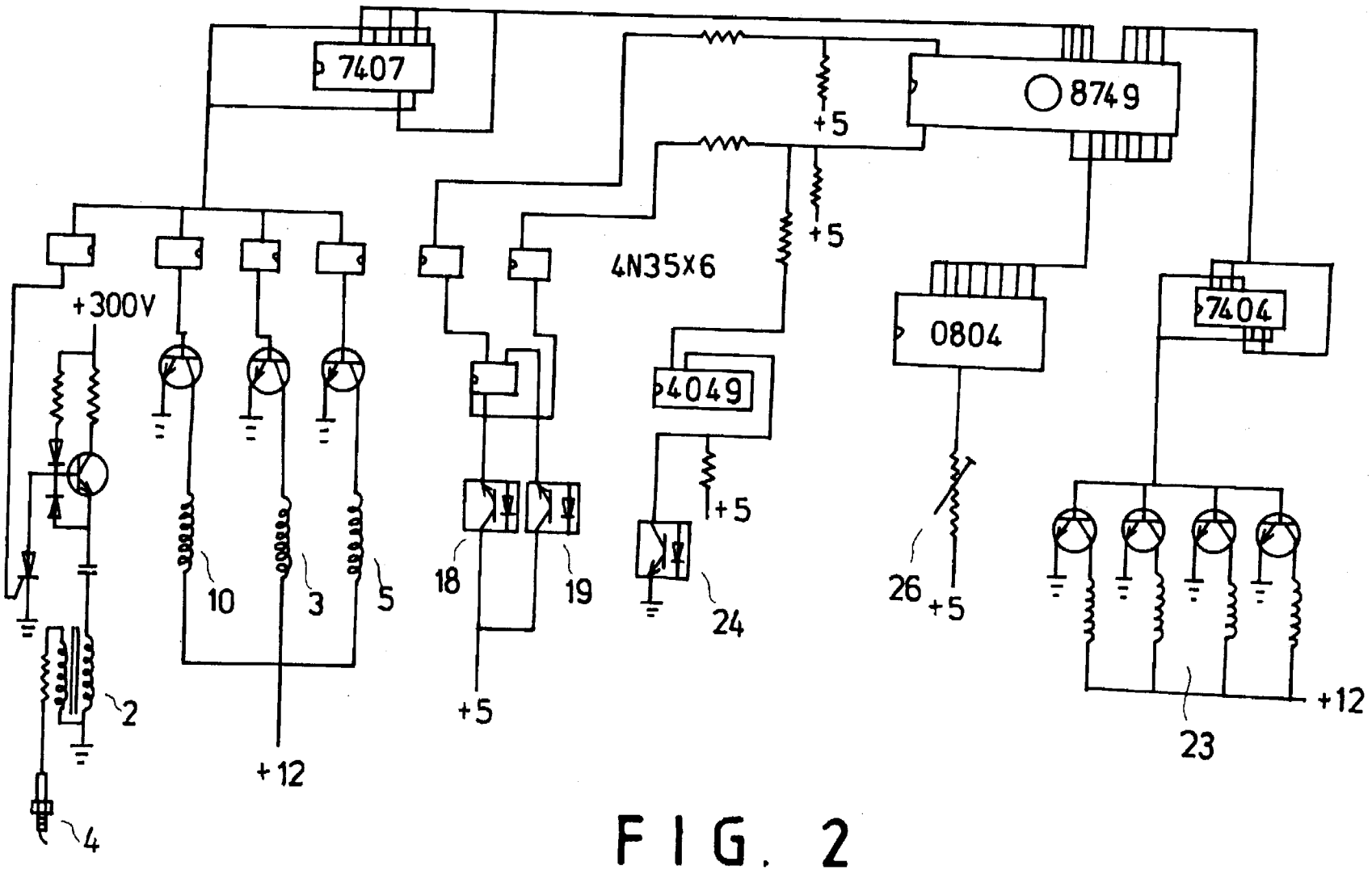
FIG. 2 illustrates an electronic control circuit for the free piston internal combustion engine.

Referring to FIG. 2, the electric control unit comprises a single chip micro-processor and interface circuits for receiving signals from the ignition sensor 18, the fuel injection sensor 19, the follower position sensor 24, and output hydraulic pressure sensor 26, CPU processes a program to operate the spark plug 4, the fuel injector 3, compressed air injectors 5, the output power adjusting motor 23, and the electromagnet 10.

The working principle of the present invention will be described in detail as follows:

The electric control unit supplies electric currents to the electromagnet 10 for holding the piston assembly 7 in place. The fuel injector 3 injects a certain amount of low boiling point fuel (such as liquidified petroleum gas, liquidified nature gas, or other suitable gas fuel) and the compressed air injector 5 injects air into the cylinder. There is a delay time about $^{20}/_{1000}$ second for forming a compressed mixture. In this process, the fuel and air pressure cannot overcome the attraction of the electromagnet 10 so that the piston 7 remains standstill. After ignition, the expansion force easily pushes the piston 7 to leave the electromagnet 10 and to move rightward. The piston converts the pressure into kinetic energy, one part of which saves in the spring 14 and the other part of which drives the plunger 15 of the hydraulic cylinder to produce a hydraulic pressure and transfer the fluid for power output.

As the piston 7 moves to the right, the exhaust port 9 and the intake port 8 will open in sequence. Waste gas is scavenged by fresh air which supplied from the scavenging cylinder 11 through the outlet valve 12 and the intake port 8 into the cylinder 6. Before the piston 7 stops, fuel injection sensor 19 will be interrupted by the push rod 17 and fuel injection will begin. When the piston 7 is stopped, the potential energy of the spring 14 will force the piston 7 to move in a reverse direction, i.e. to the left. At this time, the starting cycle is finished and the normal operating cycle begins.

During the compression stroke, mixture in the combustion chamber begins to compress after the exhaust port 9 is closed. After fuel injection, the CPU will monitor the ignition sensor 18 continuously, until the signal is detected. Then, a program begins to delay the timing of ignition. Under the correct timing, maximum power will be produced. Then, the spark plug 4 ignites the compressed mixture. Expansion force pushes the piston 7 to the right again. Exhaust-intake stroke performs automatically. CPU processes a detecting and injecting. Then a completely cycle has finished. From the detection of the fuel injection sensor 19, CPU calculates the instantaneous velocity value of piston 7. Referring to this value and according to the value of the digitalized output hydraulic pressure adjusts effective output stroke of the plunger 15. That is, the output power adjusting motor 23 drives the screw to move the follower 25 back or forth. When the push rod 17 lifted the follower 25, a hydraulic pressure will be produced to open the pressure relief valve 20. The pressure of hydraulic cylinder will relieve and stop the output power.

I claim:

1. A free piston internal combustion engine comprising:

a cylinder assembly having a power cylinder on one side, a scavenging cylinder on another side, and a magnet mounted between said power cylinder and said scavenging cylinder;

a piston provided with sealings matching said power cylinder and said scavenging cylinder, a rear end of said piston having a push rod mounted thereto and extending out of said scavenging cylinder, said rear end of said piston having a cavity formed therein;

a spring having one end disposed within said cavity of said piston and an opposing end disposed adjacent an end of said scavenging cylinder for retracting said piston; and a hydraulic cylinder assembly disposed adjacent said scavenging cylinder and including a plunger disposed within said cavity of said piston and extending therefrom, and a cylinder head mounted adjacent said scavenging cylinder for reciprocation of said plunger therein.

2. The free piston internal combustion engine as claimed in claim 1, where said power cylinder includes a power cylinder head having a fuel injector, a compressed air injector, and a spark plug mounted thereto for injecting fuel and compressed air directly into a combustion chamber portion of said power cylinder for forming a compressed mixture for a starting stroke of said internal combustion engine.

3. The free piston internal combustion engine as claimed in claim 1, wherein said rear end of said piston is formed of an iron material, said rear end of said piston contacting said magnet for forming a complete magnetic circuit and holding said piston stationary during a starting stroke of said internal combustion engine.

4. The free piston internal combustion engine as claimed in claim 1, further comprising an electric control unit which includes a single chip microprocessor and interface circuits receiving signals from an ignition sensor, a fuel injection sensor, and a follower position sensor, said micro-processor processing a program to operate a fuel injector, a compressed air injector, a spark plug and an output power adjusting motor, said micro-processor monitoring an instantaneous velocity of said piston and an output hydraulic pressure.

5. The free piston internal combustion engine according to claim 1, further comprising an inlet valve, an outlet valve, and a pressure relief valve on said hydraulic cylinder head, said push rod being able to lift a follower to open said pressure relief valve to stop an output of power from said hydraulic cylinder, said follower being adjustably positioned by a screw controlled by an output power adjusting motor.

* * * * *